US006370799B1

(12) United States Patent
Thatcher

(10) Patent No.: US 6,370,799 B1
(45) Date of Patent: Apr. 16, 2002

(54) VENTILATED FOOTWEAR ASSEMBLY

(76) Inventor: Reed E. Thatcher, 5278 Spring Leaf Ct. North, Keizer, OR (US) 97303

( * ) Notice: Subject to any disclaimer, the term of this patent is extended or adjusted under 35 U.S.C. 154(b) by 0 days.

(21) Appl. No.: 09/633,571

(22) Filed: Aug. 4, 2000

(51) Int. Cl.[7] ..... A43B 7/06
(52) U.S. Cl. ..... 36/3 B; 36/3 A
(58) Field of Search ..... 36/3 B, 3 A, 3 R

(56) References Cited

U.S. PATENT DOCUMENTS 426,495 A * 4/1890 Falkner
466,061 A * 12/1891 Locke
2,668,372 A * 2/1954 Wright
2,741,038 A * 4/1956 Eliassen
5,813,140 A * 9/1998 Obeid
5,826,349 A * 10/1998 Goss
5,975,861 A * 11/1999 Shin et al.

* cited by examiner

*Primary Examiner*—Ted Kavanaugh

(57) ABSTRACT

A ventilated footwear assembly for providing air circulation through footwear during use. The ventilated footwear assembly includes a piece of footwear with a sole portion and an upper portion, a pumping chamber positioned in the sole portion, an inlet duct extending between the pumping chamber and an exterior of the footwear, an inlet valve for preventing air flow from the pumping chamber to the inlet duct, and an outlet duct assembly extending from the pumping chamber to an interior surface of the footwear, and a outlet valve for preventing air flow from the outlet duct assembly to the pumping chamber.

13 Claims, 7 Drawing Sheets

VENTILATED FOOTWEAR ASSEMBLY

BACKGROUND OF THE INVENTION

1. Field of the Invention

The present invention relates to shoe ventilation devices and more particularly pertains to a new ventilated footwear assembly for providing air circulation through footwear during use.

2. Description of the Prior Art

The use of shoe ventilation devices is known in the prior art. More specifically, shoe ventilation devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,071,963; 5,010,661; 5,505,010; 5,697,171; 5,477,626; and U.S. Pat. No. Des. 246,944.

While these devices fulfill their respective, particular objectives and requirements, the aforementioned patents do not disclose a new ventilated footwear assembly. The inventive device includes a piece of footwear with a sole portion and an upper portion, a pumping chamber positioned in the sole portion, an inlet duct extending between the pumping chamber and an exterior of the footwear, an inlet valve for preventing air flow from the pumping chamber to the inlet duct, and an outlet duct assembly extending from the pumping chamber to an interior surface of the footwear, and a outlet valve for preventing air flow from the outlet duct assembly to the pumping chamber.

In these respects, the ventilated footwear assembly according to the present invention substantially departs from the conventional concepts and designs of the prior art, and in so doing provides an apparatus primarily developed for the purpose of providing air circulation through footwear during use.

SUMMARY OF THE INVENTION

In view of the foregoing disadvantages inherent in the known types of shoe ventilation devices now present in the prior art, the present invention provides a new ventilated footwear assembly construction wherein the same can be utilized for providing air circulation through footwear during use.

The general purpose of the present invention, which will be described subsequently in greater detail, is to provide a new ventilated footwear assembly apparatus and method which has many of the advantages of the shoe ventilation devices mentioned heretofore and many novel features that result in a new ventilated footwear assembly which is not anticipated, rendered obvious, suggested, or even implied by any of the prior art shoe ventilation devices, either alone or in any combination thereof.

To attain this, the present invention generally comprises a piece of footwear with a sole portion and an upper portion, a pumping chamber positioned in the sole portion, an inlet duct extending between the pumping chamber and an exterior of the footwear, an inlet valve for preventing air flow from the pumping chamber to the inlet duct, and an outlet duct assembly extending from the pumping chamber to an interior surface of the footwear, and a outlet valve for preventing air flow from the outlet duct assembly to the pumping chamber.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ventilated footwear assembly apparatus and method which has many of the advantages of the shoe ventilation devices mentioned heretofore and many novel features that result in a new ventilated footwear assembly which is not anticipated, rendered obvious, suggested, or even implied by any of the prior art shoe ventilation devices, either alone or in any combination thereof.

It is another object of the present invention to provide a new ventilated footwear assembly which may be easily and efficiently manufactured and marketed.

It is a further object of the present invention to provide a new ventilated footwear assembly which is of a durable and reliable construction.

An even further object of the present invention is to provide a new ventilated footwear assembly which is susceptible of a low cost of manufacture with regard to both materials and labor, and which accordingly is then susceptible of low prices of sale to the consuming public, thereby making such ventilated footwear assembly economically available to the buying public.

Still yet another object of the present invention is to provide a new ventilated footwear assembly which provides in the apparatuses and methods of the prior art some of the advantages thereof, while simultaneously overcoming some of the disadvantages normally associated therewith.

Still another object of the present invention is to provide a new ventilated footwear assembly for providing air circulation through footwear during use.

Yet another object of the present invention is to provide a new ventilated footwear assembly which includes a piece of footwear with a sole portion and an upper portion, a pumping chamber positioned in the sole portion, an inlet duct extending between the pumping chamber and an exterior of the footwear, an inlet valve for preventing air flow from the pumping chamber to the inlet duct, and an outlet duct assembly extending from the pumping chamber to an interior surface of the footwear, and a outlet valve for preventing air flow from the outlet duct assembly to the pumping chamber.

Still yet another object of the present invention is to provide a new ventilated footwear assembly that reduces fungal growth.

Even still another object of the present invention is to provide a new ventilated footwear assembly that reduces perspiration and odor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
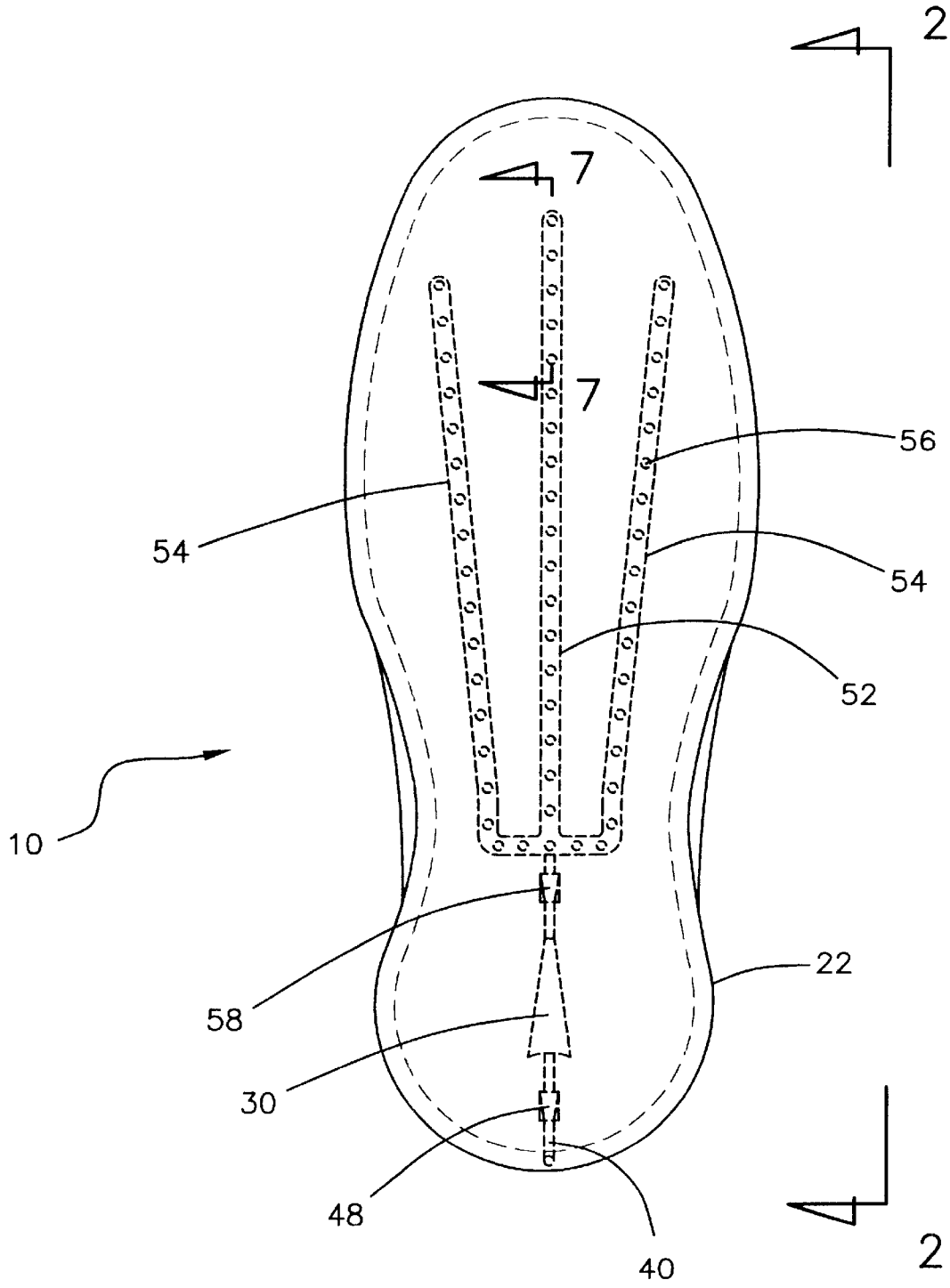
FIG. 1 is a schematic bottom view of a new ventilated footwear assembly according to the present invention.
Figure 2:
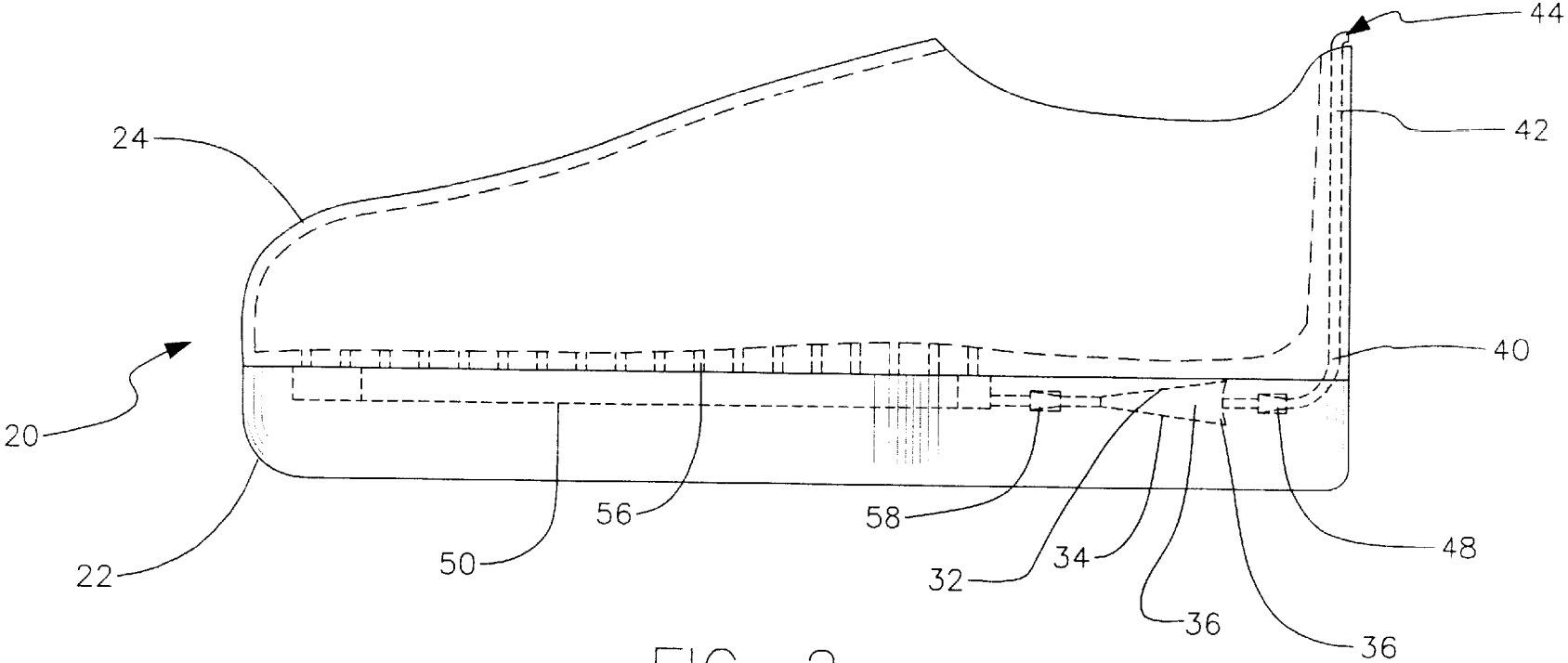
FIG. 2 is a schematic cross-sectional view of the present invention taken along line 2—2 of FIG. 1.
Figure 3:
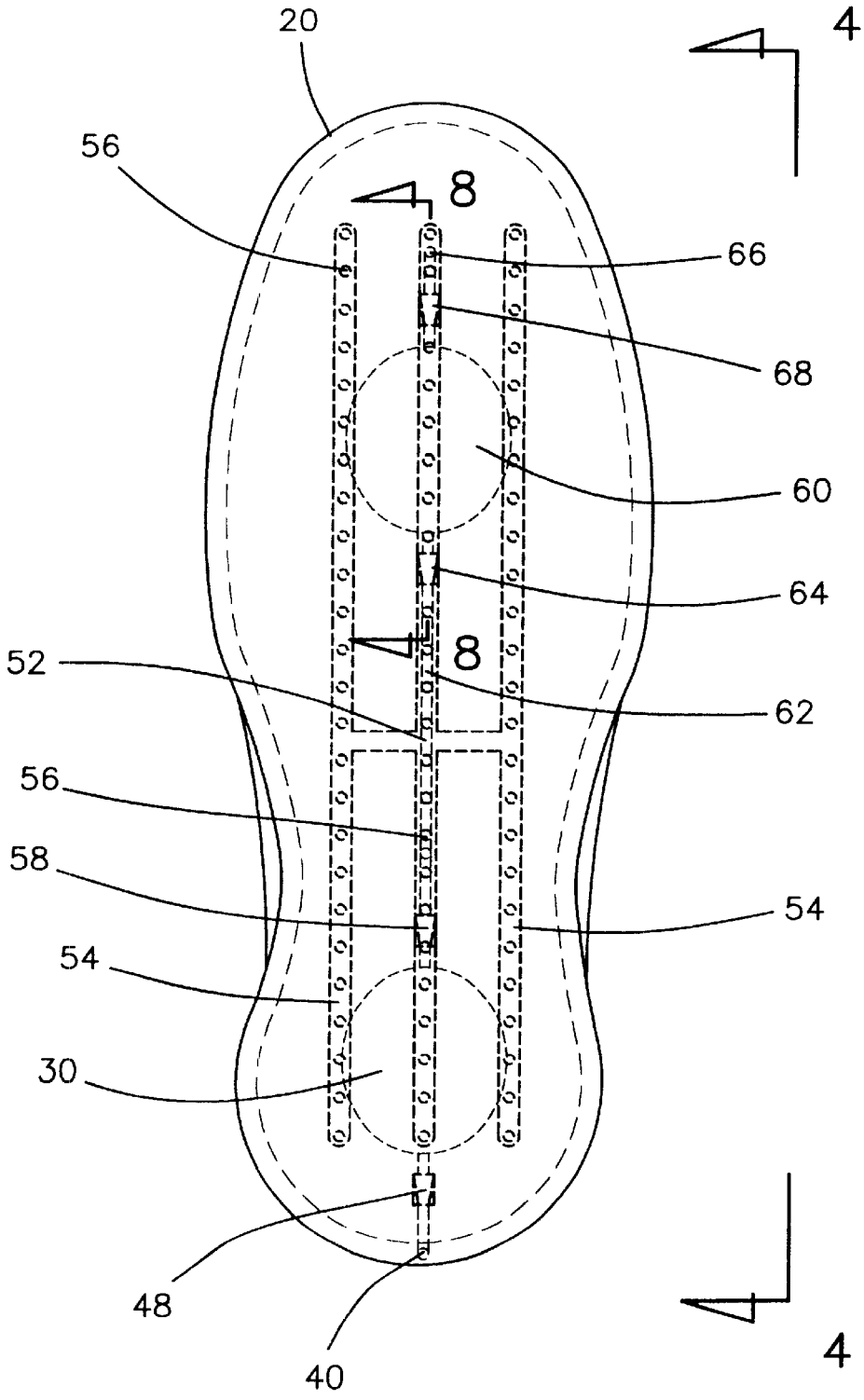
FIG. 3 is a schematic bottom view of an embodiment of the present invention.
Figure 4:
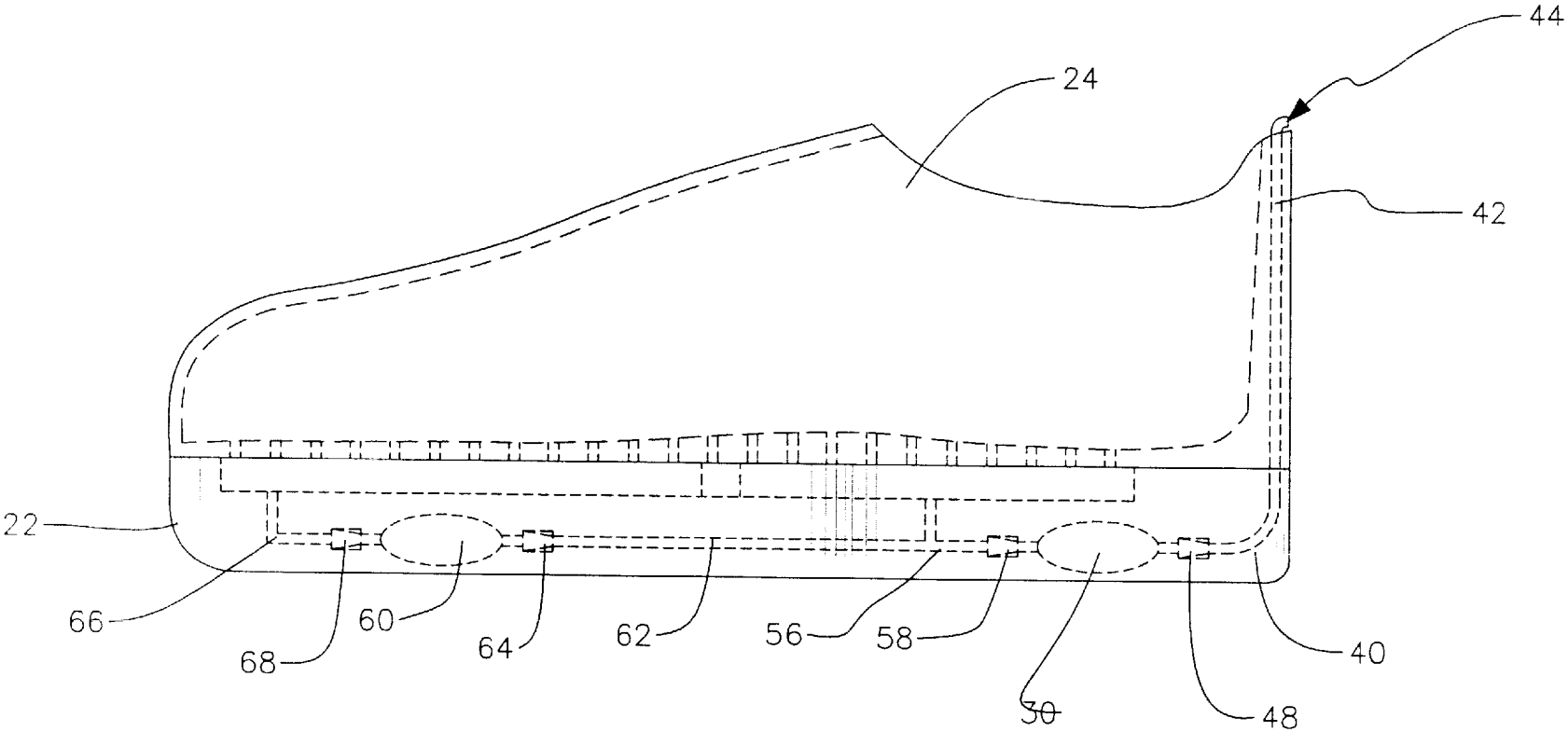
FIG. 4 is a schematic cross-sectional view of the present invention taken along line 4—4 of FIG. 3.
Figure 5:
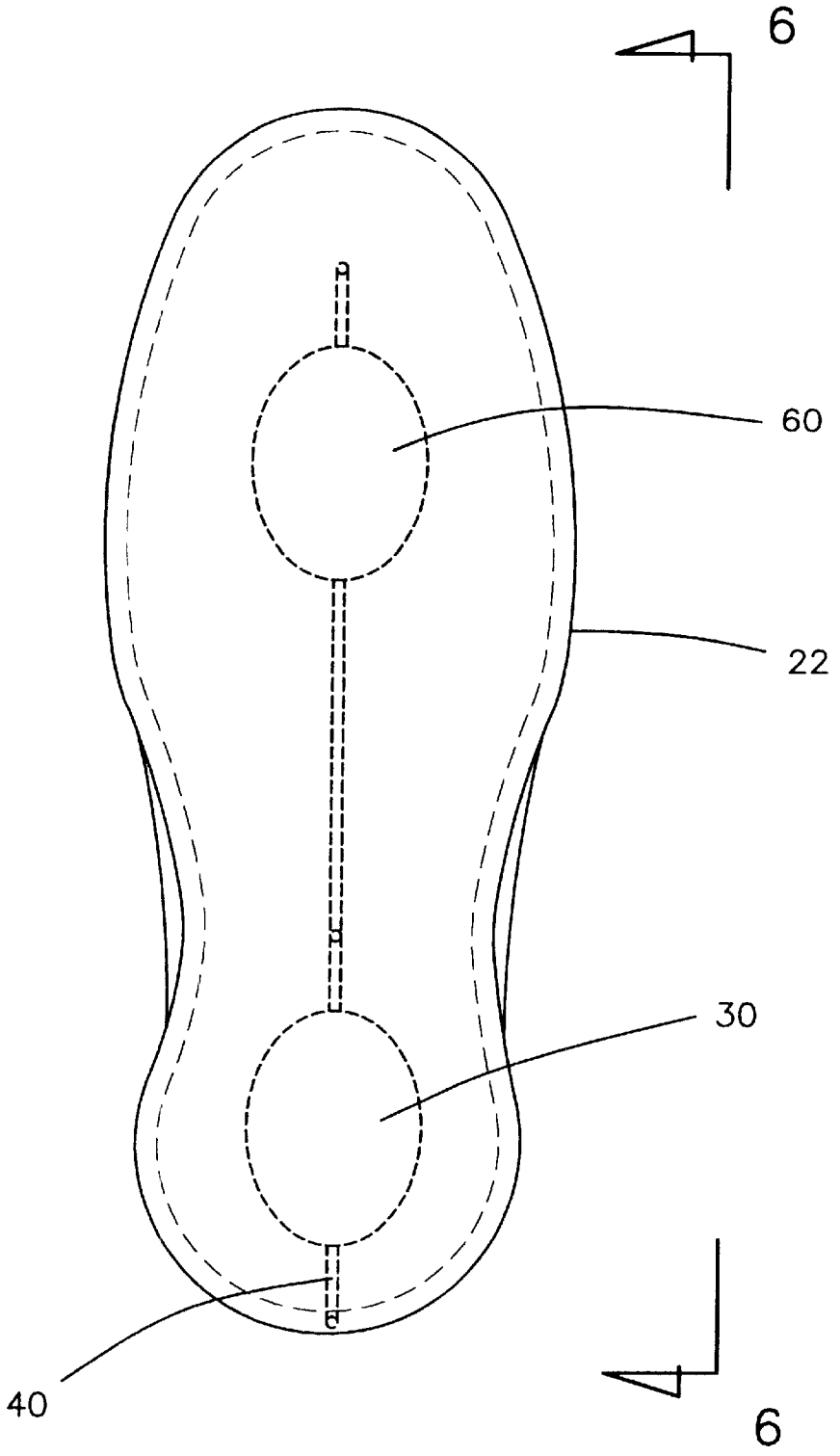
FIG. 5 is a schematic bottom view of an embodiment of the present invention.
Figure 6:
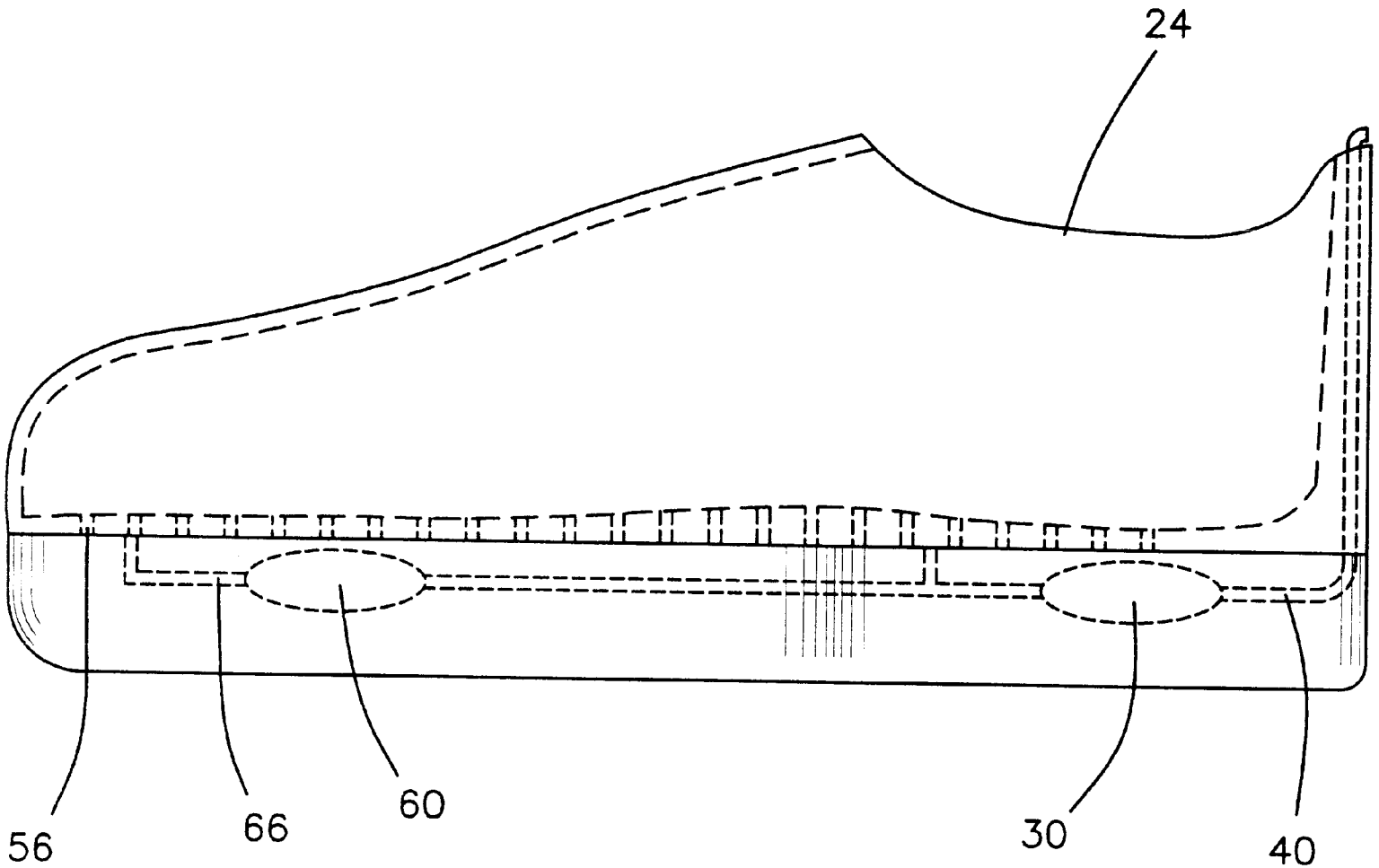
FIG. 6 is a schematic cross-sectional view of the present invention taken along line 6—6 of FIG. 5.
Figure 7:
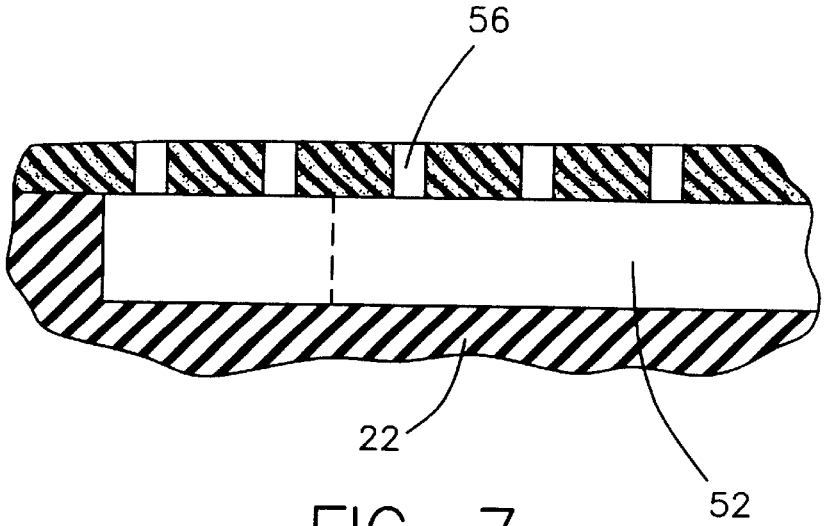
FIG. 7 is a schematic detail view of the present invention taken along line 7—7 of FIG. 1.
Figure 8:
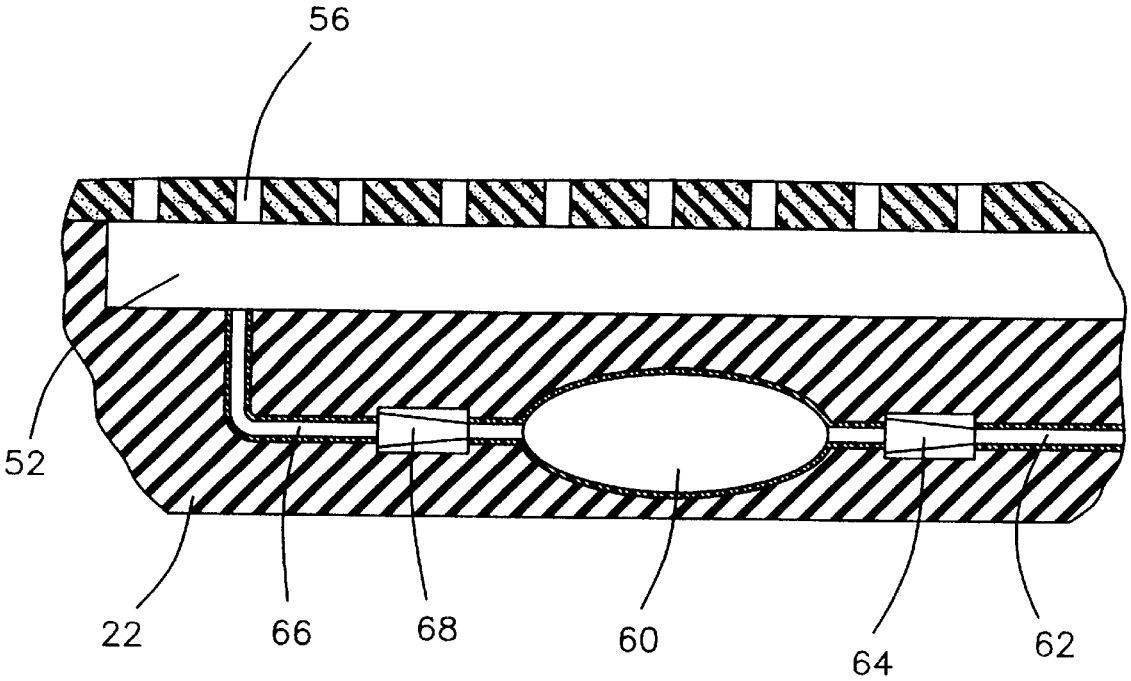
FIG. 8 is a schematic detail view of the present invention taken along line 8—8 of FIG. 3.

With reference now to the drawings, and in particular to FIGS. 1 through 8 thereof, a new ventilated footwear assembly embodying the principles and concepts of the present invention and generally designated by the reference numeral 10 will be described.

As best illustrated in FIGS. 1 through 8, the ventilated footwear assembly 10 generally comprises a piece of footwear 20, a pumping chamber 30, an inlet duct 40, an inlet reed valve 48, an outlet duct 56, and an outlet reed valve 58.

The piece of footwear 20 is designed for securing to a human foot. The piece of footwear 20 includes a sole portion 22 and an upper portion 24 forming an interior designed for receiving the human foot.

The pumping chamber 30 is positioned in the sole portion 22. The pumping chamber 30 is positioned such that the pumping chamber 30 is designed to be compressed by a heel of the human foot as a user puts weight onto the piece of footwear 20.

The inlet duct 40 extends between a medial portion of the rear wall of the pumping chamber 30 and an exterior surface of the piece of footwear 20. The inlet duct 40 extends upwardly proximate to a back of the piece of footwear 20 such that the inlet duct 40 forms an inlet opening 44 designed for being positioned proximate to an Achilles tendon of the user when the piece of footwear 20 is engaged to the human foot of the user.

The inlet duct 40 includes a distal end portion 42 extending outwardly from the upper of the piece of footwear 20. The distal end portion 42 is generally L-shaped such that the inlet opening 44 is designed for facing away from the human foot when the human foot is engaged to the piece of footwear 20 for facilitating environmental communication between the inlet opening 44 and air surrounding the piece of footwear 20.

The inlet reed valve 48 is coupled to the inlet duct 40 for preventing air from flowing from the pumping chamber 30 into the inlet duct 48.

The outlet duct assembly 50 extends between the pumping chamber 30 and an interior surface of the piece of footwear 20 for providing air from the pumping chamber 30 to the interior of the piece of footwear 20. The outlet duct assembly 50 includes a plurality of main conduits. Each of the main conduits extends lengthwise within the sole portion 22.

The plurality of main conduits includes a central conduit 52 which extends substantially along a central portion of the sole portion 22 of the piece of footwear 20.

The plurality of main conduits includes a pair of outer main conduits 54. Each of the outer main conduits 54 extends in spaced relationship along a respective side of the central conduit 52.

The outlet duct assembly 50 includes a plurality of outlet ducts 56. Each of the outlet ducts 56 extends from an associated one of the main conduits 54. Each of the outlet ducts 56 includes an associated outlet opening in environmental communication with the interior of the piece of footwear 20.

The outlet reed valve 58 is coupled to the outlet duct assembly 50 adjacent to the pumping chamber 30 for preventing air from flowing from the outlet duct assembly 50 into the pumping chamber 30.

In an embodiment, a second pumping chamber 60 is positioned in the sole portion 22. The second pumping chamber 60 is positioned proximate to a front of the piece of footwear 20 such that the second pumping chamber 60 is adapted for being compressed by a front portion of the human foot as a user puts weight onto the piece of footwear 20. A second pumping chamber inlet duct 62 extends between a rearward portion of the outlet duct assembly 50 and the second pumping chamber 60. A second pumping chamber inlet reed valve 64 is coupled to the second pumping chamber inlet duct 62 for preventing air from flowing into the second pumping chamber inlet duct 62 from the second pumping chamber 60. A second pumping chamber outlet duct 66 extends between the second pumping chamber 60 and a forward portion of the outlet duct assembly 50 for facilitating air flow to the forward portion of the outlet duct assembly 50. A second pumping chamber outlet reed valve 68 is coupled to the second pumping chamber outlet duct 66 for preventing air from flowing from the forward portion of the outlet duct assembly 50 into the second pumping chamber 60.

In a further embodiment, the pumping chamber 30 has an arcuate rear wall 36, a substantially planar upper wall 32 and a substantially planar lower wall 34. The upper 32 and lower walls 34 are angled such that a height of the pumping chamber 30 tapers as the pumping chamber 30 extends towards a front of the piece of footwear 20. Thus the pumping chamber 30 has a generally triangular vertical cross-section. A distal end of each of the outer main conduits 54 is angled outwardly extending away from said pumping chamber 30. Thus the outer main conduits 54 are designed for facilitating delivery of air to outer portions of the human foot.

In use, the user wears the footwear in the conventional manner. As the user steps on the heel of the footwear, the pumping chamber is compressed forcing air through the outlet reed valve and into the central conduit and main conduits where it is conducted to the interior of the footwear through the outlet ducts. As the user steps on the ball portion of the foot, and relieves the pressure on the heal portion of the foot, the pumping chamber expands drawing air in through the inlet opening. This process is repeated with each step of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ventilated footwear assembly comprising:

a piece of footwear adapted for securing to a human foot, said piece of footwear having a sole portion and an upper portion forming an interior adapted for receiving the human foot;

a pumping chamber positioned in said sole portion;

an inlet duct extending between said pumping chamber and an exterior surface of said piece of footwear;

an inlet valve for preventing air from flowing from said pumping chamber into said inlet duct;

an outlet duct assembly extending between said pumping chamber and an interior surface of said piece of footwear for providing air from said pumping chamber to said interior of said piece of footwear;

an outlet valve for preventing air from flowing from said outlet duct assembly into said pumping chamber; and said inlet duct having a distal end portion extending outwardly from said upper of said piece of footwear such that an inlet opening into said inlet duct is positioned above said upper of said piece of footwear, said distal end portion being generally L-shaped such that said inlet opening into said inlet duct is adapted for facing away from the human foot when the human foot is engaged to said piece of footwear for facilitating environmental communication between said inlet duct and air surrounding said piece of footwear.

2. The ventilated footwear assembly of claim 1, further comprising:

said pumping chamber being positioned such that said pumping chamber is adapted for being compressed by a heel of the human foot as a user puts weight onto said piece of footwear.

3. The ventilated footwear assembly of claim 2, further comprising:

said inlet duct extending between a medial portion of said rear wall of said pumping chamber and an exterior surface of said piece of footwear, said inlet duct extending upwardly proximate a back of said piece of footwear such that said inlet opening is adapted for being positioned proximate an Achilles tendon of the user when the piece of footwear is engaged to the human foot of the user.

4. The ventilated footwear assembly of claim 2, further comprising:

said inlet duct extending between a medial portion of said rear wall of said pumping chamber and an exterior surface of said piece of footwear, said inlet duct extending upwardly proximate a back of said piece of footwear such that said inlet opening is adapted for being positioned proximate an Achilles tendon of the user when the piece of footwear is engaged to the human foot of the user;

said outlet duct assembly including a plurality of main conduits, each of said main conduits extending lengthwise within said sole portion.

5. The ventilated footwear assembly of claim 1, further comprising:

said inlet duct extending between a medial portion of said rear wall of said pumping chamber and an exterior surface of said piece of footwear, said inlet duct extending upwardly proximate a back of said piece of footwear such that said inlet duct forms an inlet opening adapted for being positioned proximate an Achilles tendon of the user when the piece of footwear is engaged to the human foot of the user.

6. The ventilated footwear assembly of claim 1, further comprising:

said inlet valve being a reed valve coupled to said inlet duct for preventing air from flowing from said pumping chamber into said inlet duct.

7. The ventilated footwear assembly of claim 1, further comprising:

said outlet duct assembly including a plurality of main conduits, each of said main conduits extending lengthwise within said sole portion.

8. The ventilated footwear assembly of claim 7, further comprising:

said plurality of main conduits including a central conduit extending substantially along a central portion of said sole portion of said piece of footwear.

9. The ventilated footwear assembly of claim 7, further comprising:

said plurality of main conduits including a pair or outer main conduits, each of said outer main conduits extending in spaced relationship along a respective side of said central conduit.

10. The ventilated footwear assembly of claim 7, further comprising:

a plurality of outlet ducts, each of said outlet ducts extending from an associated one of said main conduits, each of said outlet ducts having an associated outlet opening in environmental communication with said interior of said piece of footwear.

11. The ventilated footwear assembly of claim 1, further comprising:

said outlet valve being a reed valve coupled to said outlet duct assembly adjacent to said pumping chamber for preventing air from flowing from said outlet duct assembly into said pumping chamber.

12. A ventilated footwear assembly comprising:

a piece of footwear adapted for securing to a human foot, said piece of footwear having a sole portion and an upper portion forming an interior adapted for receiving the human foot;

a pumping chamber positioned in said sole portion, said pumping chamber being positioned such that said pumping chamber is adapted for being compressed by a heel of the human foot as a user puts weight onto said piece of footwear;

an inlet duct extending between a medial portion of said rear wall of said pumping chamber and an exterior surface of said piece of footwear, said inlet duct extending upwardly proximate a back of said piece of footwear such that said inlet duct forms an inlet opening adapted for being positioned proximate an Achilles tendon of the user when the piece of footwear is engaged to the human foot of the user;

said inlet duct having a distal end portion extending outwardly from said upper of said piece of footwear such that said inlet opening into said inlet duct is positioned above said upper of said piece of footwear, said distal end portion being generally L-shaped such that said inlet opening into said inlet duct is adapted for facing away from the human foot when the human foot is engaged to said piece of footwear for facilitating environmental communication between said inlet duct and air surrounding said piece of footwear;

an inlet reed valve coupled to said inlet duct for preventing air from flowing from said pumping chamber into said inlet duct;

an outlet duct assembly extending between said pumping chamber and an interior surface of said piece of footwear for providing air from said pumping chamber to said interior of said piece of footwear;

said outlet duct assembly including a plurality of main conduits, each of said main conduits extending lengthwise within said sole portion;

said plurality of main conduits including a central conduit extending substantially along a central portion of said sole portion of said piece of footwear;

said plurality of main conduits including a pair of outer main conduits, each of said outer main conduits extending in spaced relationship along a respective side of said-central conduit;

a plurality of outlet ducts, each of said outlet ducts extending from an associated one of said main conduits, each of said outlet ducts having an associated outlet opening in environmental communication with said interior of said piece of footwear; an outlet reed valve coupled to said outlet duct assembly adjacent to said pumping chamber for preventing air from flowing from said outlet duct assembly into said pumping chamber.

13. The ventilated footwear assembly of claim 12, further comprising:

said pumping chamber having an arcuate rear wall, a substantially planar upper wall and a substantially planar lower wall, said upper and lower walls being angled such that a height of said pumping chamber tapers as said pumping chamber extends towards a front of said piece of footwear whereby said pumping chamber has a generally triangular vertical cross-section; and a distal end of each of said outer main conduits being angled outwardly extending away from said pumping chamber whereby said outer main conduits are adapted for facilitating delivery of air to outer portions of the human foot.

* * * * *